US007018200B2

(12) United States Patent
Querejeta et al.

(10) Patent No.: US 7,018,200 B2
(45) Date of Patent: Mar. 28, 2006

(54) COMBUSTION DETECTION DEVICE WITH A THERMOELECTRIC GENERATOR

(75) Inventors: Félix Querejeta, Vitoria-Gasteiz (ES); José J. Anttxia, Aretxabaleta (ES)

(73) Assignee: Fagor, S. Coop., Mondragon (ES)

( * ) Notice: Subject to any disclaimer, the term of this patent is extended or adjusted under 35 U.S.C. 154(b) by 253 days.

(21) Appl. No.: 10/705,382

(22) Filed: Nov. 10, 2003

(65) Prior Publication Data

US 2004/0096790 A1 May 20, 2004

(51) Int. Cl.
*F23N 5/10* (2006.01)

(52) U.S. Cl. ..... 431/80; 431/77; 126/39 G
(58) Field of Classification Search ..... 431/80, 431/77, 51; 126/39 G; 137/66
See application file for complete search history.

(56) References Cited

U.S. PATENT DOCUMENTS 4,734,139 A * 3/1988 Shakun et al. ..... 136/210
5,427,086 A * 6/1995 Brownell ..... 126/110 R
2005/0037303 A1* 2/2005 Bachinski et al. ..... 431/80

* cited by examiner

*Primary Examiner*—Alfred Basichas
(74) *Attorney, Agent, or Firm*—The Kline Law Firm

(57) ABSTRACT

The apparatus (1,1') for the detection of gas combustion in an domestic gas heater or a water heater is designed as an independent installation unit mounted on a shared support bracket (8,8'), provided with a thermoelectric generator assembly (4–6, 20–26) for supplying a safety valve (16) and a main gas valve (17) of the gas heater, generating two respective lower (Vb) and higher (Vd) voltages therefor. The thermoelectric assembly (4–6,20–26) heated by a pilot flame (3) is built up by means of one or two flat Peltier type p-n junction cells (4, 20–21), which are connected to a heat transmission element (5,25) licked by the pilot flame (3) and to a shared heat sink (6,22).

6 Claims, 3 Drawing Sheets

COMBUSTION DETECTION DEVICE WITH A THERMOELECTRIC GENERATOR

TECHNICAL FIELD

The present invention relates to an apparatus for detecting gas combustion in a domestic environment heater or water heater, provided with a pilot burner, an igniter and a thermoelectric unit that generates a voltage for the supply of a safety valve and a main valve, using only flat Peltier type cells for the thermoelectric generation.

PRIOR ART

In a combustion control system of a free-standing gas heater, a self-contained thermoelectric generator is required for supplying both the electrical ignition and flame detection circuits and at least two electromagnetic valves that supply gas to the pilot burner and to the main burner. Combustion control systems of this type are already known, as for instance that disclosed in U.S. Pat. No. 4,770,629, wherein the thermoelectric unit is built with a thermopile heated directly by the pilot flame, from which two respective DC voltage values are obtained for two valves. In unventilated domestic environment heaters, there is a further requirement that the safety device should detect combustion anomalies that cause a deficiency in the pilot flame, acting as a room air oxygen depletion sensor (ODS).

An appliance for combustion control and self-contained generation of two DC voltages in a domestic heating system is described in U.S. Pat. No. 5,674,065, comprising a pilot burner, an igniter, a thermocouple to keep the safety valve open, and a thermopile to supply the main gas valve of the heater, all installed on a bracket type support, wherein both thermoelectric generating elements are cylindrical with a tip positioned at a given distance from the pilot flame for precise heating.

Use of thermoelectric deveices for generating a DC voltage is well known in free-standing heater appliances, as for instance in U.S. Pat. No. 6,335,572-B1 and DE-4301872-A, which are built with flat semiconductor PN junction cells, wherein both flat outer faces of the thermoelectric cell are connected respectively to the heater appliance heating and cooling means. The thermoelectric unit disclosed in U.S. Pat. No. 6,335,572-B1 l is heated by a pilot burner and generates a DC voltage to supply an electronic control circuit, including a safety valve solenoid, a main gas supply valve solenoid and a rechargeable battery.

DISCLOSURE OF THE INVENTION

The object of the present invention is an apparatus for the detection of gas combustion in an environment heater or in a water heater, adapted for flame detection including oxygen depletion, and supplying two separate dc voltages for a heater safety valve and a main valve, by means of a pilot burner and a thermoelectric generator unit made up of at least one flat Peltier type cell, wherein the generator is heated by a heat transmitter element licked by the pilot flame.

An objective of the invention is to provide the combustion detection apparatus with a compact thermoelectric unit constructed by means of flat Peltier type semiconductor PN junction cells of higher efficiency and quicker response than the thermopiles used in the prior art apparatuses. Consequently, the means for transfer and dissipation of heat to each of the opposing hot and cold sides of the flat cells are adapted to combined installation with a pilot burner and an igniter on a shared flat plate support, for its fitting in the environment heater appliance. The thermoelectric unit is built with at least one flat Peltier cell and uses only the pilot flame as the heat source, producing two separate power outputs, one of them of a low de voltage of around 20 mV–200 mA for the safety valve electromagnet, and the other output of a high voltage value of 1.5 V for the main valve solenoid and for supplying the control electronic unit of the heater appliance too.

An advantage of the thermoelectric group according to the invention over those used in the prior art apparatuses is the time needed—less than 5 s from pilot flame ignition—for generating enough power, more than 100 mA, to keep the safety valve electromagnet actuated, and the rapid disappearance of this power in a time of less than 10 s when the pilot flame become extinguished or is affected by faulty combustion, for the closing of the safety valve.

DETAILED DESCRIPTION OF PREFERRED EMBODIMENTS

Figure 1:
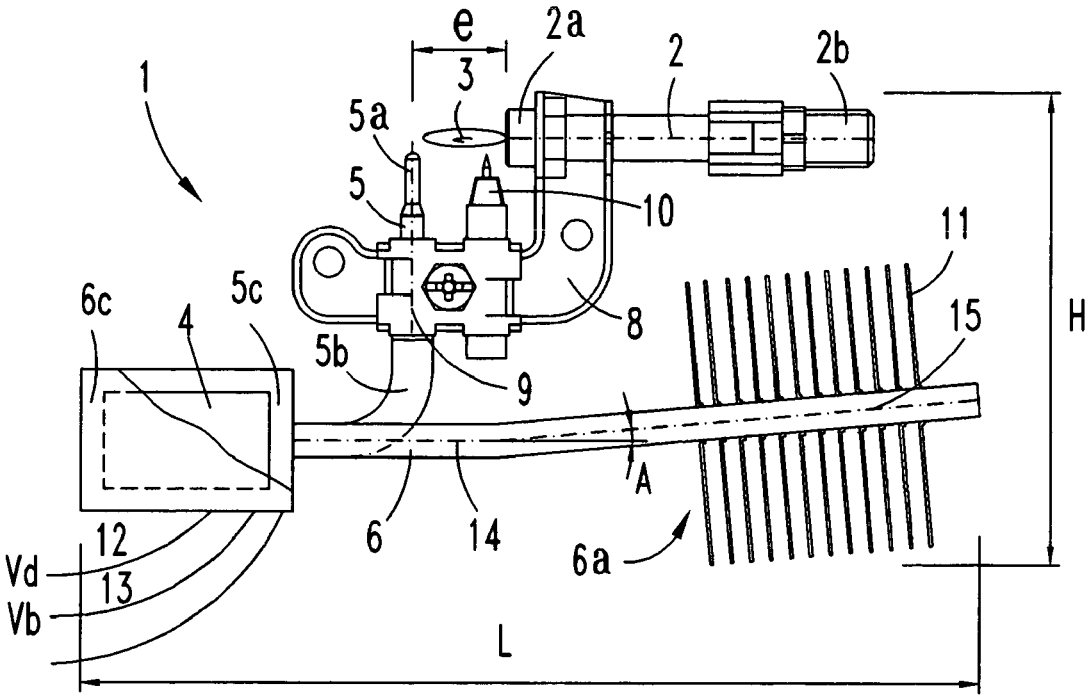
FIGS. 1–2 are elevational and plan views respectively of an embodiment of an apparatus for detecting gas combustion provided with a pilot burner and a thermoelectric generator.
Figure 2:
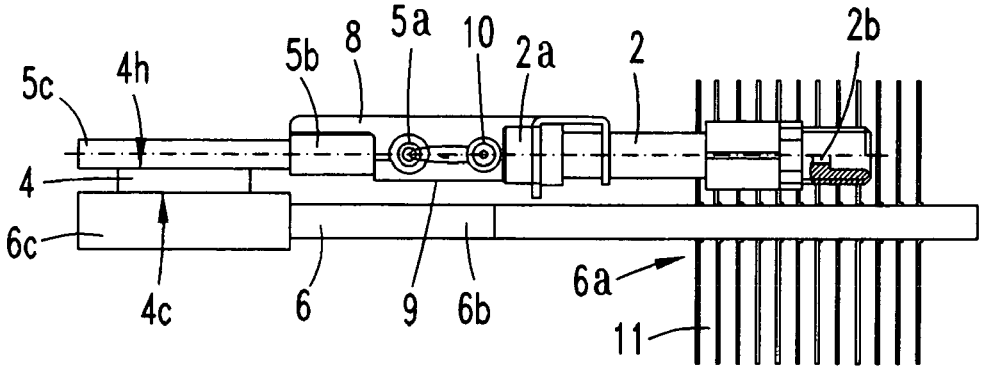

FIGS. 1–5 show two embodiments 1,1' of an apparatus for detecting gas combustion in accordance with the invention, as an independent unit for installation in a free-standing environment heater or in a water heater. The detection apparatus 1 represented in FIGS. 1–2 is made up of a single flat thermoelectric cell 4, while the apparatus represented in FIGS. 3–4 comprises two flat cells 20, 21.

In reference to FIGS. 1–2, a first preferred embodiment of the detection apparatus 1 comprises a support frame 8 for mounting the detection apparatus 1, an elongated burner 2 with a jet 2*a* that emits a pilot flame 3, an igniter 10 of the pilot flame 3, and a thermoelectric assembly (4–6) including a Peltier type thermoelectric cell 4 that operates by Seebeck effect, and formed by means of two flat sides parallel to each other, the hot side 4*h* and the cold side 4*c*, an element 5 for transmitting the heat from the pilot flame 3 to the thermoelectric cell 4, and a heat exchanger 6 for dissipating the heat from the cold side 4*c* of the cell to the environment.

By means of the heat transmitter element 5 connected to the hot side 4*h* of the cell and of the heat exchanger 6 connected to the cold side 4*c*, a temperature difference is maintained between the two opposite sides 4*h* and 4*c* of the cell, whereby the thermoelectric cell 4 generates an electric power of a dc voltage (FIG. 5) of , for instance, 1.5 V, with a current of 110 mA, which is supplied to an electric circuit in the temperature control system, not shown in the drawings.

In the embodiment described here, the thermoelectric cell 4 is of a commercial type, consisting of a series of thermoelectric PN junctions, which takes the form of a thin flat plate and the two opposite sides 4*h* and 4*c* made of electrical insulating ceramic material, such as aluminium oxide, with dimensions of approximately 25×25 mm. The cell 4 is away from the pilot flame as its temperature resistance is limited to 250° C. The elongated transmitter element 5 is made of a metallic material that is a good heat conductor and has a thermal head 5*a* for the pilot flame 3, which reaches a flame temperature of around 700° C. The thermal head 5*a* is heated directly by the pilot flame 3 for generating the electric power in the thermoelectric cell 4.

The permanent heating of the thermal head 5*a* by the pilot flame 3 is also used for detecting oxygen depletion (ODS) in the ambient air, which causes the flame 3 to flicker or go out, by means of producing a voltage Vb (FIG. 5) generated for energizing a safety valve, which is of low value compared with a voltage Vd around 1,5 V–110 mA generated between the two ends of the cell 4, for supplying either a main valve with the heater main gas flow, or an appliance electronic unit. Cell 4 has two electric cable outputs 12,13 for supplying these two voltage values, Vd and Vb respectively, to the combustion control system. The first cell output 13 supplies the low voltage, such as Vb=0.02 V open circuit, or a short-circuit current of 150 mA, needed to keep the small 17 milli-ohm electromagnet of a safety valve that controls the gas flow to the pilot burner 2 excited.

Besides said thermal head 5*a* interposed to the flame 3, the heat transmitter element 5 also comprises an elongated transmitter member 5*b*, which is either integral with the thermal head 5*a* or welded to it, and a flat part 5*c* in contact with the hot side 4*h* of the cell. The latter has a larger area than cell 4, for instance 37×25 mm. Through the transmitter element 5 the hot side 4*h* of the cell reaches a temperature of up to 230° C. The transmitter element 5 is supported along with the pilot burner 2 on the mounting frame 8, which is made of metal plate. The thermal head 5*a* of the transmitter element is attached to the frame 8 by means of a fastening clamp 9, opposite the burner jet 2*a*, and keeping a position relative to the length of the pilot flame 3. To detect the unwanted changes in the pilot flame 3, this relative position of the head 5*a* is set at a distance "e" separating the thermal head 5*a* from the burner jet 2*a*. This relative distance of the thermal head 5*a* also determines the rate of rise of the voltage Vb at output 13 generated by cell 4, when the pilot burner 2 is initially ignited.

Figure 5:
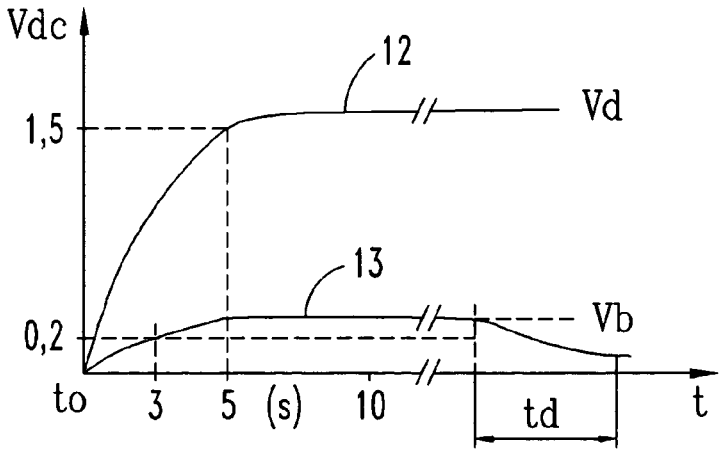
FIG. 5 is a diagram of the voltage generated by the thermoelectric group of any of the apparatuses of FIGS. 1–4 in accordance with the heating time.

A diagram is represented in FIG. 5 showing the rise in DC voltage generated at both outputs 12 and 13 by cell 4 in accordance with the heating time "t" expressed in seconds, resulting in a response of short duration, such as t<5 s for Vb=0.02 V. FIG. 5 also shows the decrease in the low voltage Vb at output 13 down to 50% of the load steady value, when the thermoelectric unit 1 has detected either a shortening of the pilot flame 3 due to oxygen depletion or the flame going out, in a time "td" of several seconds as of detection. This relative position "e" of the thermal head 5*a* is variable by moving the said clamp 9 attaching it to the installation frame 8.

The pilot burner 2 is cylindrical in shape and extends in a horizontal direction like the flame emitted, secured in a fixed position on the installation frame 8, and in this way the pilot flame 3 emitted falls directly onto the thermal head 5*a*. The elongated burner 2 has a flame 3 emitting jet 2*a* and at the opposite end a gas supply connection 2*b*. To keep the cell 4 away from the burner 2, the transmitter element 5 and the cell 4 extend in a direction opposite to that of the burner 2. The frame 8 also optionally supports an ignition spark electrode 10, which may be activated by the Vd voltage generated in the output 12.

The detection apparatus 1 may also be used coupled to a water heater, provided that the thermal head 5*a* is interposed facing a burner nozzle or hole, and the generator unit support frame is adapted to this burner.

The heat sink 6 connected to the cold side 4*c* of the thermoelectric cell may also be adapted to the base of a water heater.

The intermediate member 5*b* of the transmitter element is preferably made of copper pipe filled with a good heat conducting fluid so that the temperature gradient between the thermal head 5*a* and the flat connecting part 5*c* to the cell 4 may be low. The transmitter tube 5*b* has a cross section adapted for the connection with the thermal head 5*a*.

The heat exchange 6 consists of a heat sink 6*a* away from the thermoelectric cell 4 and the pilot flame 3, an exchanger conductor member 6*b* and a flat connecting part 6*c* to the cold side 4*c* of the cell, which has a larger area than the latter. In one example of embodiment the exchanger conductor member 6*b* is a copper tube filled with heat conductor fluid, of a diameter of 6 mm for example. The heat sink 6*a* is made up of a series of fins 11 welded onto a central body 15 joined to said conductor member 6*b* of the heat exchanger 6. The conductor member 6*b* may also be made of a flat copper conductor linked to a heat sink, the latter being made of a metallic profile.

In the example of construction of the detection apparatus 1 represented in FIGS. 1–2, the support frame 8 and the pilot burner 2 extend in a horizontal direction when the detection apparatus 1 is installed in the heater, occupying between the two a space approximately 100 mm long. The thermoelectric cell 4 occupies a position set to one side of the frame 8. The heat exchanger 6 has an elongated shape and extends preferably horizontally from the thermoelectric cell 4 to the burner 2, in order that the heat sink 6*a* may be sited in a position away from the flame 3, without increasing the overall length "L" of the detection apparatus 1 so that it is compact. In the example of embodiment represented in FIGS. 1–2, the burner 2 and the heat sink 6*a* are superimposed in a single space relative to the volume occupied by the detection apparatus 1. Its overall length "L" proves thereby to be less than 150 mm. The conductor member 6*b* may be oriented at an angle of inclination "A" in relation to a central horizontal line 14 of cell 4, for example of 5 degrees, so that the extent of the heat sink fins 11 does not increase the total height "H" of the apparatus 1, limited in this way to 80 mm.

Figure 3:
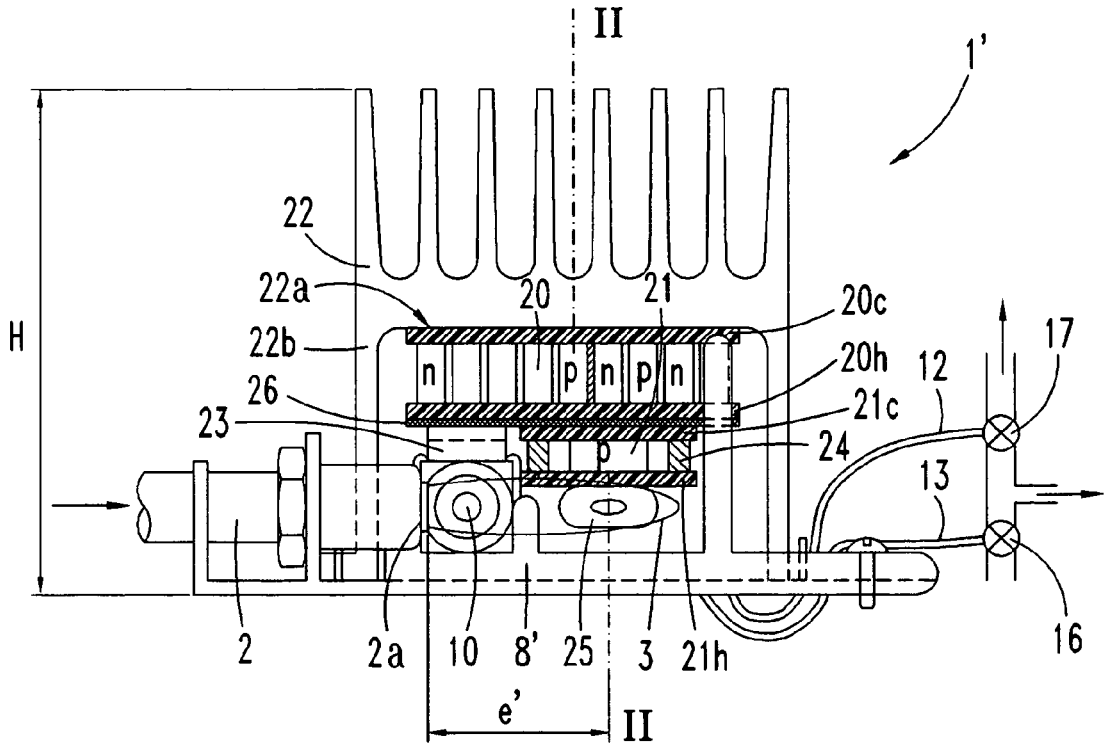
FIG. 3 is an elevational view of a second embodiment of an apparatus for detecting gas combustion provided with a pilot burner and a thermoelectric generator.
Figure 4:
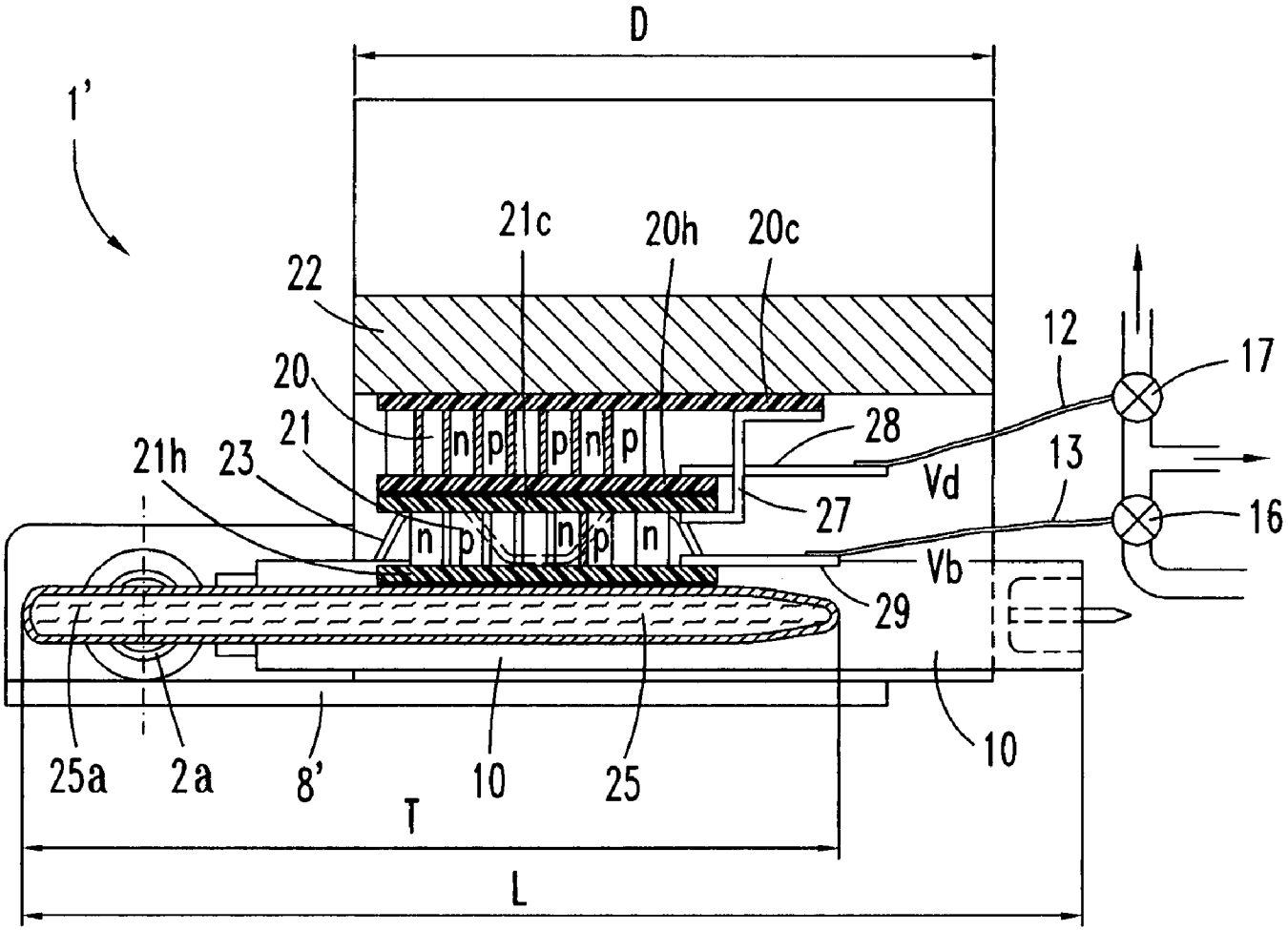
FIG. 4 is a sectional view of the apparatus for detecting combustion of FIG. 3, according to line IV—IV.

In reference to FIGS. 3–4, a second preferred embodiment of the detection apparatus 1 is adapted as an independent unit for its installation on a free-standing environment heater or water heater, and the generation of a lower voltage Vb around 20 mV, 200 mA, for energizing a safety valve 16, and the generation also of a higher voltage Vd higher than 1.2 V for supplying the main valve 17 of the apparatus and the heater electronic unit, the latter not being shown in the drawings. The combustion detection apparatus 1' comprises the following items, mounted on a shared flat plate support 8': an elongated burner 2 with a jet 2*a* that emits a pilot flame 3, an igniter 10, and a thermoelectric assembly 20–26 which provides dc voltage outputs Vb and Vd, with this thermoelectric assembly 20–26 forming a compact unit with the burner 2 and the igniter 10 on the plate support 8'. The thermoelectric cells 20, 21 are protected against impacts and external forces by the actual natural convection heat sink 22, which surrounds them like a cover. The thermoelectric cell output terminals 28, 29 (FIG. 4) are also covered under the heat sink 22, and provided by soldering with two pairs of electrical connection wires for the solenoid valves.

The burner 2, the igniter 10 and the heat sink 22 are supported directly on the flat support 8'. The thermoelectric assembly 20–26 comprises two flat cells 20, 21 of a different area, matching the voltage value Vb, Vd generated. The heat sink 22 is provided with two side support legs 22*b* attached to the base of the support 8' which form a recess in the heat sink 22 where the cells block 20,21 is installed, resting against a flat contact surface 22*a* of the heat sink. The thermoelectric block 20,21,25 is held against the heat sink 22 under pressure by means of a tensioned spring element, such as a spring leaf 23 attached to the igniter 10. The spring leaf 23 in turn offsets the dimensional deviations in the thickness of the cells 20,21, in the surrounding heat sink 22, and exerts a thermal contact of the larger cell 20 against the flat surface 22*a* of the heat sink. The smaller cell 21 overlaps the larger cell 20, with one side edge of both aligned, so that on the larger cell a part of its surface remains free to engage the spring leaf 23. This installation layout of the two cells 20,21 enables the total height "H" of the detection apparatus 1' to become small.

In the embodiment of apparatus 1' shown in FIGS. 3–4, the thermoelectric assembly 20–26 is made up of two flat cells 20,21, each of them with a series of hot and cold p-n junctions between semiconductor elements, which are series and parallel-connected in combination to generate the desired voltage Vb, Vd. The PN junctions of each thermoelectric cell are soldered on a printed circuit between a pair of ceramic plates 20*c*, 20*h*, and 21*c*, 21*h*, external and parallel to them, which are electrical insulators but good thermal conductors. Cells 20,21 may also be built with metallic outer plates coated with an insulating layer.

FIG. 5 shows the generation of the DC voltage by the detection apparatus 1'. The larger area cell 20 generates the high voltage Vd of at least 1.2 V in the direction of the output 12, with a current of around 110 mA sufficient to operate a main gas valve 17 which actuates with a minimun value of 0.8 V and to supply the igniter 10 and the electronic unit of the appliance. The smaller area cell 21 generates the low voltage Vb of 20 mV open circuit and a current a current of up to 200 mA towards output 13 of the safety valve 16, whose electromagnet is approximately 17 milliohms. A current value generation time response is obtained in the smaller cell 21 greater than the 100 mA needed for the maintenance of the safety valve. FIG. 5 also shows the raising of both voltages Vd, Vb through the respective outputs 12 and 13 in accordance with the heating time "t" from pilot flame ignition. The response of the smaller cell 21 is of short duration for energizing the safety valve 16, such as t<5 s for Vb=0.02 V (>100 mA) at output 13, and Vd>1.2 V for t=5–10 s at output 12. Also shown is the crop in the low voltage Vb for the safety valve down to 50% of its load steady value in a time "td" less than 10 seconds from the moment of detecting a deficiency in the pilot flame 3, due to oxygen depletion or its extinction.

FIGS. 3–4 show the two thermoelectric cells 20–21 superimposed and joined by means of a layer of soft solder 26. The free area of the smaller cell 21 thereby forms the hot side 21*h*, connected thermally by means of soft solder to a heat transmitter tube 25, the end of which has a thermal head 25*a* licked by the pilot flame 3. To achieve swift disappearance of the difference in temperature between the sides 21*h* and 21*c* of the smaller cell 21 when the flame 3 goes out, the hot 21*h* and cold 21*c* ceramic plates are inter-connected internally by means of two side heat bridges in the form of copper bars 24 soldered on the internal faces of each cell plates 21*h*,21*c*, for transmitting the heat from the transmission tube 25 to the larger cell 20, so that this is heated too, and in turn for decreasing the safety valve 16 shut-off time when the flame 3 is extinguished.

The heat transmission tube 25 is made straight and of a length "T" (FIG. 2) as short as possible, depending on the arrangement of the heat sink 22 on the burner 2 common support 8' so that the detection apparatus 1' may be compact. At the same time it is necessary to keep the cell 21 away from the pilot flame, as its temperature resistance is limited to 350° C. To take advantage of the heating power of the pilot flame 3, a flat hollow metal tube is preferred with a large contact area and filled with a fluid with good heat transmitting properties. Thus, the end of the tube 25 licked by the flame is heated to a temperature of around 700° C. and the end soldered to the larger cell may reach a temperature of up to 200° C.

The transmitter tube 25 is fly-supported by the thermoelectric cell block 20,21 and kept in a position matching the length of the pilot flame 3. To detect anomalies on the appliance combustion, this position of the thermal head 25*a* is set to a given separation distance "e'" from the burner jet 2*a*, in order to secure prompt cooling in the event of some deficiency occurring in the pilot flame 3. This relative position of the thermal head 25*a* is also adjusted to achieve a quick increase in the low voltage Vb generated by the smaller cell 21 after ignition.

In the example of embodiment of apparatus 1' described here, using an electromagnet of around 17 milliohms for the safety valve 16, as the generation of these values of Vb and Vd and the afore-mentioned speed of response of the smaller cell are required, it was decided to construct the thermoelectric cells 20, 21 with an area of 33×23 mm and 23×11 mm, respectively. The width of the flat transmitter tube 25 is less than 8 mm and its length "T" approximately 50 mm. The heat sink 22 also has to have a longitudinal dimension "D" sufficient to cover the area of the cells 20,21 and their external connection terminals 28,29. The combustion detection apparatus 1' assembled in this way and shown in FIGS. 3–4 does not exceed an overall length "L" of 60 mm.

What is claimed is:

1. Apparatus for detecting gas combustion adapted to a domestic free-standing gas heater or a water heater provided with a safety valve (16), a main gas valve (17) and an electronic control unit, the detection apparatus (1') comprising, a mounting bracket (8') for supporting the detection apparatus (1') shaped for fitting on the gas heater or the water heater, a pilot burner (2) with at least one pilot flame (3) for faulty combustion detection, and an igniter (10) incorporated on the support bracket (8'), a thermoelectric generator assembly (20–26) heated by the pilot flame (3), supplying through two electric outputs (13,12) respectively, a low voltage (Vb) for energizing said safety valve (16) and for detection of combustion deficiencies in the pilot flame (3), and a higher voltage (Vd) for powering the main valve (17) and the electronic unit of the gas heater, wherein the thermoelectric assembly (20–26) is incorporated on said support bracket (8') forming a compact mounting unit with the pilot burner (2), and includes two flat thermoelectric cells (20,21) made up with semiconductor p-n junctions, each one provided with one of said electrical outputs (13,12), a heat transmission element (25) which is licked by the pilot flame (3), a heat sink (22) to the environment forming a thermal path (25,21,20,22) shared by both thermoelectric cells (20,21), and thermal connection means (24,26) between both cells (20,21).

2. The gas combustion detection apparatus according to claim 1, wherein said two thermoelectric cells (20,21) are of different areas from each other, one larger and one smaller, whose hot cold sides are made up of flat insulating plates (20*c*–21*h*), and both cells (20,21) are mounted in an overlapping position in thermal contact with each other, forming said shared thermal path (25,21,20,22) between said heat transmission element (25) connected to the hot plate (21*h*) of the smaller cell (21), and said heat sink (22) connected to the cold plate (20*c*) of the larger cell (20).

3. The gas combustion detection apparatus according to claim 1, wherein both thermoelectric cells (20,21) are of different areas, one larger and one smaller, and are overlapping, connected thermally to each other with an aligned side edge, while a part of the larger cell (20) is left free for the tensioned engagement of a spring element (23), which secures the two cells (20,21) up against the heat sink (22).

4. The gas combustion detection apparatus according to claim 1, wherein both flat thermoelectric cells (20,21) are each built with two outer insulating plates (20*c*–21*h*) parallel to each other, and said thermal connection means (24,26) of both cells (20,21) for transmitting heat between them comprise a thermal connecting layer (26) between two superimposed plates (20*h*,21*c*) of both cells and at least one heat bridge in the form of a copper bar (24) built into one of the cells (21) for the direct transmission of part of the heat received by this first cell (21) to the other second cell (20), in order said low voltage (Vb) to be removed by cooling said first cell (21) up to the safety valve shutoff, at a time response quicker than 10 s.

5. The gas combustion detection apparatus according to claim 1, wherein the heat sink (22) is metallic with natural ventilation fins, and is provided with two side legs (22*b*) for attachment to the support bracket (8') of the detection apparatus, said heat sink (22) forming a compact housing for installing and covering the thermoelectric cells (20,21).

6. The gas combustion detection apparatus according to claim 1, wherein both thermoelectric cells (20,21) being of different areas, one larger and one smaller, and connected thermally to each other, said heat transmission element (25) has at one end a thermal head (25*a*) licked by the pilot flame (3) positioned at a given separation distance (e') from the pilot burner jet (2*a*), and at the other end is thermally connected to the smaller cell (21), for a rapid rise of said low detection voltage (Vb) generated for energizing said safety valve (16) in a time (t) of less than 5 s from the pilot burner ignition.

* * * * *